United States Patent [19]

Weingartner et al.

[11] Patent Number: 4,790,149

[45] Date of Patent: Dec. 13, 1988

[54] FLATBED KNITTING MACHINE WITH ELECTRONIC CONTROL

[75] Inventors: Albin Weingartner; David Retallick, both of Munich, Fed. Rep. of Germany

[73] Assignees: Universal Maschinenfabrik; Rudolf Schieber GmbH, both of Westhausen, Fed. Rep. of Germany

[21] Appl. No.: 231,525

[22] Filed: Feb. 4, 1981

[30] Foreign Application Priority Data

Oct. 1, 1979 [DE] Fed. Rep. of Germany ..... 2939820

[51] Int. Cl.[4] ..... D04B 7/00

[52] U.S. Cl. ..... 66/75.2

[58] Field of Search ..... 66/75.2, 231, 232, 238; 364/470

[56] References Cited

U.S. PATENT DOCUMENTS

| | | | |
|---|---|---|---|
| 3,817,059 | 6/1974 | Krause | 66/232 |
| 3,825,900 | 7/1974 | Anderson | 66/75.2 |
| 3,844,139 | 10/1974 | De Cerjat et al. | 364/470 X |
| 4,018,064 | 4/1977 | Doslik | 66/232 |
| 4,192,157 | 3/1980 | Hida et al. | 66/75.2 |
| 4,269,045 | 5/1981 | Hida et al. | 66/75.2 |

FOREIGN PATENT DOCUMENTS

| | | | |
|---|---|---|---|
| 1398924 | 6/1975 | United Kingdom | 364/470 |

*Primary Examiner*—Ronald Feldbaum

*Attorney, Agent, or Firm*—Sughrue, Mion, Zinn, Macpeak, and Seas

[57] ABSTRACT

In a flatbed knitting machine with electronic control and comprising programmable fixed-word stores and freely accessible stores, all the data for the operation of the machine is split into five divisions, namely motif pattern draft, needle set-up, knitting plan, function number schedule, and plan run. Data for the knitting of standard patterns, comprising the whole of the knitting plan division and part of the function number schedule division, is stored permanently in the fixed word stores. The stored data for the operation of the machine can be extracted and archived. Parts of the data of the divisions can be extracted to compose new patterns. Certain knitting courses can be suppressed and certain needle groups can be selected for adjustment without altering the already stored data. Information as to gauge can also be entered.

12 Claims, 10 Drawing Sheets

MC1488, 1489A
PIN 1: -12V
7: LOG GND
74LS04,10
PIN 7: LOG GND
14: +5V
8T26
PIN 8: LOG GND
16: +5V
20 PIN DOUBLE-HEADER $8900 'BAND'
26 PIN DOUBLE-HEADER $8A00 'BF'
C1 ACIA 6850 $6900
B1 PIA 6820 $8A00
DTDS-12D100 DC/DC
MC 14411 B5
1.8432 MHz

LOG GND
RS-232-C
+5V
+12V
-12V

| FIG. 3A | FIG. 3B |
|---|---|

DATA
ADDRESSES
PROM7
E6
PROM6
D6
PROM5
E4
PROM4
D4
PROM3
E3
PROM2
D3
PROM1
E1
PROM0
D1
EPROM 2716
74LS42
C5
74LS10
C6
B5
B6
10K
+5V
A11
A13
A12
A15
A14
PROM DISABLE

| | |
|---|---|
| | FIG. 5C |
| FIG. 5A | FIG. 5B |

FLATBED KNITTING MACHINE WITH ELECTRONIC CONTROL

FIELD OF THE INVENTION

This invention relates to a flatbed knitting machine with electronic control, comprising programmable fixed-word stores in the form of PROMs and freely accessible stores in the form of RAMs, as well as structural means for entering the data for the operation of the machine.

DESCRIPTION OF THE PRIOR ART

One such flatbed knitting machine with electronic control is known from published West German patent application No. 2301847. In that machine the entry of the data is accomplished either by means of a magnetic tape store or manually.

In flatbed knitting machines with electronic control the entry of data for the operation of the flatbed knitting machine is very complex and time-consuming, with the result that until now this data entry procedure has been carried out successfully only by specially trained specialists.

SUMMARY OF THE INVENTION

It is an object of the present invention to provide a flatbed knitting machine of the type first referred to above in which the entering of data into the flatbed knitting machine can be carried out by persons who are relatively unskilled in the art of data entry procedures, with minimum expenditure, and with minimum likelihood of errors being made in the entering of the data.

This achieved in accordance with the present invention in that the electronic control system is constructed and connected in such a way that the data is arranged to be entered and stored in the electronic control system split into five divisions, motif pattern draft, needle set-up, knitting plan, function number schedule and plan run; and the data for the knitting of standard patterns, comprising the whole of the division for knitting plan and part of the division for function number schedule, is arranged to be stored in the fixed-word stores of the electronic control system.

The knitting plan division contains all data which is necessary for the functioning of the machine for one course of knitting, while the additional data from the function number schedule division which is stored in the fixed-word stores contains the sequence of such functions in the courses of knitting. Consequently, all machine-specific data for the knitting of standard patterns is stored permanently in the electronic control system of the flatbed knitting machine, and only the pattern-specific data from the divisions for motif pattern draft, needle set-up and plan run and from the remaining part of the function number schedule division has to be processed by the operator and entered into the flatbed knitting machine.

The standard patterns, the data for which is stored permanently in the machine, are preferably multicoloured and inverted Jacquard patterns, such as two-colour Jacquard patterns, three-colour Jacquard patterns, four-colour Jacquard patterns, half-tubular inverted patterns and cable patterns.

In one embodiment of flatbed knitting machine in accordance with the invention, the data for the standard patterns from the knitting plan division and the necessary part of the function number schedule division is entered on the machine directly into the fixed-word stores of the electronic control system. Alternatively, this data can be read into the fixed stores of the electronic control system by means of a prepared external data carrier, preferably a magnetic tape.

The structure and connection of the electronic control system may be further developed in such a way that the data of the appropriate divisions not relevant to the standard patterns can be entered into the stores of the electronic control system, split according to the divisions, directly on the machine or by way of a prepared external data carrier, again preferably a magnetic tape. The entry of this data can be effected together with the data entry for the standard patterns.

A single function key can be provided on the machine by means of which the data for a standard pattern can be called up.

In order further to simplify the data entry procedure, the electronic control system of the flatbed knitting machine is preferably constructed and connected in such a way that all data for the operation of the flatbed knitting machine for each division individually or in combination can be extracted from the stores of the electronic control system and transferred to external data carrier means, for example a magnetic tape cassette. The data on the external data carrier can then be used in the extracted sequence or in some new combination for the entry of the archived pattern and operating data or the entry of a newly produced pattern. It is important that all data necessary for the operation of the flatbed knitting machine should be extracted and archived.

The electronic control system can be constructed and connected in such a way that parts of the data of the divisions, from a minimum of the data for one needle, can be extracted and transferred to the external data carrier. This gives one practically unlimited possibilities for composing new patterns from the extracted and archived data.

According to a preferred embodiment of the flatbed knitting machine, presettable counters are provided on the machine by means of which commands for a selection of one or more needle groups for the knitting can be entered without altering the data already entered and stored. The data in the counters has priority over the data of the divisions, so that, for example, the needle spacing width can be changed independently of the knitting program, possibly in the case of a pattern repeat being automatically interrupted. Consequently, alterations can be made to the width of the knitted garment without having to interfere with the knitting program.

According to yet another preferred feature of the flatbed knitting machine, switches are provided on the machine by means of which commands to suppress one or more courses of knitting can be entered without altering the data which has already been entered and stored. With a length limit facility of this type, the length of the knitting can be shortened, taking precedence over the knitting program, especially the plan run division. The pattern can be broken off at any length with the assurance that the thread guide and the rack will be located in the necessary basic position when one begins again. This data entry into the machine takes place outside the entry of the data for the five program segments.

Finally, the flatbed knitting machine may be arranged in such a way that a keyboard or a switch is provided on the machine by means of which information as to the gauge of the flatbed knitting machine can be entered directly into the electronic control system. Consequently, the later entry of data for the operation of a flatbed knitting machine will automatically be adapted to the particular chosen group.

BRIEF DESCRIPTION OF THE DRAWINGS

The invention will be more clearly understood from the following description in conjunction with the accompanying drawings wherein.

Figure 1:
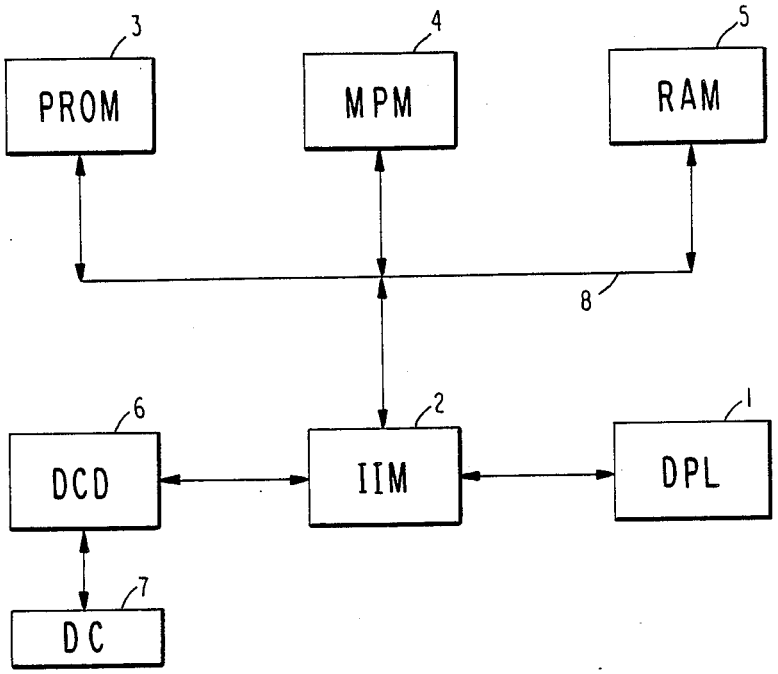
FIG. 1 is a block diagram of an electronic control system in the flatbed knitting machine according to the present invention.

The invention is further explained with reference to the following particular embodiment which is given by way of example.

For the entry of data for the operation of a flatbed knitting machine with electronic control, a complete knitting program is preferably provided on a magnetic tape. This magnetic tape is then read into the electronic control system of the machine with the aid of a tape playing machine. The electronic control system of the flatbed knitting machine includes fixed-word stores, for example in the form of PROMs, and freely accessible stores, for example in the form of RAMs. With such a control system the data for the operation of the machine can be complemented by reading in one or more divisions or parts of divisions of data and thereby creating a new overall program.

The putting together of the data is effected with the aid of specially prepared form sheets, with a form sheet being allocated to each division of data. The actual programming procedure can be carried out with the aid of several magnetic tapes, for example two magnetic tapes, one of which contains for example three divisions of data and the other of which contains two divisions of data.

All the data for the operation of the flatbed knitting machine is split into a total of five divisions in order to make possible a simple and error-free data entry procedure with the smallest possible amount of work on the part of the operator entering the data.

The five divisions of data are a first division for motif pattern draft T, a second division for needle set-up N, a third division for knitting plan Z, a fourth division for function number schedule F and a fifth division for plan run S.

The first division of data for motif pattern draft T corresponds to a technical draft for the knitting, stitch transfer and stitch acceptance for the forward needle beds in, for example, the setting up of a cable pattern.

The second division of data for needle set-up N includes the horizontal extent of the knitting process. A normal entry is possible with automatic repeat over the whole machine width. More than eight knitted strips or needle spacing widths must be established over the individual entry. A total of up to 64 needle set-ups is possible. Furthermore, up to 64 selector switches are provided on the machine with a maximum of 255 repetitions of data and data groups.

The data both for the division for motif pattern draft T and also for the division for needle set-up N are pattern-specific data.

The third division for knitting plan Z refers to the establishment of rows for standard patterns, i.e. the data about what should happen in a row, for example inversion, shifting, starting, finishing off, thread guide selection. This division for knitting plan Z includes machine-specific data for the knitting of standard patterns, coloured and inverted Jacquard patterns, such as two-colour Jacquard patterns, three-colour Jacquard patterns, four-colour Jacquard patterns, half-tubular inverted patterns and cable patterns. The data of this division for knitting plan Z is entered into the fixed-word stores of the electronic control system of the flatbed knitting machine and can be called up from there by a function key or can be transferred to external data carriers for archive storage. The fourth division of data is the division for function number schedule F. This division includes the data about the insertion of the function rows laid down in the division for knitting plan Z, such as about the insertion of function rows from the pattern-specific data. Each recurring function row can be called up at random from the machine-specific division for knitting plan Z. The data of the division for function number schedule F which is wholly relevant to the division for knitting plan Z is likewise transferred into the fixed-word stores of the machine. The remaining pattern-specific data from the division for function number schedule F is entered into the electronic control system of the machine each time that the machine is prepared for use. The division for function number schedule F refers among other things to the pattern repeat of the knitted piece.

The fifth division of data is the division for plan run S. This division includes pattern-specific data for the vertical extent of the knitting. The data is entered into the electronic control system by the operator each time that the machine is prepared for the knitting operation.

As already mentioned, the data for the standard pattern of coloured and inverted Jacquard pattern, for example half-tubular inverted patterns, cable pattern or 2, 3 and 4-colour Jacquard pattern, can be composed as permanently recurring data and can be established in the division for the data relating to knitting plan Z. This is possible up to a maximum of 320 for the plan lines, since the knitting run as such is always uniform for the aforementioned standard patterns. The data of the division for knitting plan Z is then stored permanently in the control system of the flatbed knitting machine together with the data of the division for function number schedule F which is additionally necessary for the standard pattern. The data remains there for call-up or for transfer from the stores for archive storage purposes. The data of the remaining divisions is established anew each time and is entered into the machine. Thus, for the whole extent of the knitting, all the data of the five divisions are used jointly. It is true that different motif pattern drafts T show different motif patterns, but from the point of view of knitting technique they have the same run.

For the pattern entry, it is possible to carry this out either with the help of an entry unit from an external data carrier in the form of a magnetic tape cassette and from there to pass the information into the control system, or alternatively the data can be entered directly into the control system from the control desk without a magnetic tape cassette. The latter type of entry has the advantage that the entry unit and the magnetic tape cassette are then not absolutely necessary, as for example if they were not available because of repair or use on another machine. Furthermore, corrections can be fed into the machine by way of the operator's desk and an associated tape replacement by playing over a fault-free magnetic tape.

With the splitting of the data necessary for the operation of the flatbed knitting machine into the divisions for motif pattern draft T, needle set-up N, knitting plan Z, function number schedule F and plan run S, and with the storage of the data for the knitting of standard patterns from the complete division for knitting plan Z as well as the necessary part of the division for function number schedule F, in the fixed-word stores of the electronic control system of the flatbed knitting machine, there is achieved not only the greatest possible simplification of data entry into the machine, but it is also possible to archive the data for the complete knitting program quickly and cheaply. This archiving can be carried out by calling up and transferring complete data on to one or more external data carriers, for example magnetic tapes. External data carriers containing all the data for a particular knitting process of one or more knitted pieces can be used again for the entry of the data into the machine by trainee auxiliary personnel. In addition to this, it is possible, using the data archived on the external data carriers, to establish displays of data which give the operator a direct oversight of the stored data in a form specific to the knitting machine.

Besides a complete archiving as described above, a partial archiving is also possible, i.e. such that the data of each of the five divisions can be called up and archived group-wise. Obviously, the data of several part groups can also be called up and archived on an external data carrier. Finally, it is possible, and provided for, that any part of the data of a sub-group, from a minimum of the data for one needle, can be called up and archived. Also, the data from different machines can be received in sub-groups and combined to give a total data archive storage. By combining individual divisions of data or data sub-groups, it is possible to carry out a rapid and cheap plotting of new overall data for the operation of the flatbed knitting machine with another combination of knitted pieces and patterns. The reproduction of the archived data on further external data carriers, especially in the form of magnetic tape cassettes, poses no difficulties with the described method.

A further possibility for the simplification of the entry of data for the operation of the flatbed knitting machine consists of establishing needle spacing widths by allocated instructions for a choice of one or more needle groups for the knitting. The entry of these instructions into the machine takes place by way of pre-settable counters on the machine without altering any of the data already entered and stored in the electronic control system, and similarly for the partial groups of data. The establishment of the needle spacing width is thus independent of the knitting program, although the determination of the needle spacing width is associated with the knitting program and possibly breaks up a wide pattern repeat. The data corresponding to the instructions for the establishment of the needle spacing width can however, as necessary, be transferred to external data carriers and archived, together with all the data relating to the knitting program. With this type of allocated establishment of the needle spacing width, the needle spacing used for the knitting can be chosen as desired. For example, the gauge E12 of the needle bed corresponds to a total needle count of 972 per needle bed. Within this total needle count the needle spacing can be chosen as desired, for example from needle 91 to 890, if the working width should amount for example to 800 needles.

Furthermore, it is possible to prepare for and to enter into the machine the knitting of up to eight separate knitted pieces of the same or different widths, for example for shawls and the like, with the aid of the establishment of the needle spacing width with an unchanged knitting program. The allocated establishment of the needle spacing width makes it possible to change the width of the knitted piece without interfering with the knitting program.

A similar extension of the described method is one in which instructions for a suppression of one or more courses of knitting is entered by way of switches or the like without altering the data already entered and stored. Here also, these instructions are allocated again to the knitting program. With such a length limitation, the knitted length can be shortened in relation to the data laid down by the division for plan run S. On the assumption that the thread guides and the rack will be returned to their necessary basic positions at the beginning again of the knitting, the pattern can be interrupted at any length.

Finally, information as to the gauge of the flatbed knitting machine can be entered directly into the electronic control system by way of a keyboard by means of a code or by way of a switch. Here one is talking about an automatic preparation of the electronic control system of the flatbed knitting machine for the later data entry for automatic processing of the information as to the gauge in the data entry procedure.

The construction and connection of the electronic control system of the flatbed knitting machine will be additionally explained based on the block diagram shown in FIG. 1.

In the block diagram according to FIG. 1 block 1 is an element mounted in the frame of the flatbed knitting machine which contains a key board, a display, counter means and switch means.

Block 2 is an internal interface module IIM, block 3 is a programmable read only memory PROM, block 4 is a microprocessor module MPM, and block 5 is a random access data memory RAM, the blocks 2 to 5 being constructed as IC modules.

Block 1 and block 2 are interconnected in a well-known manner for bidirectional communications. The IC modules or blocks 2, 3, 4 and 5 operate on a common address, data and control bus 8 and receive information and signals respectively from this bus 8. The part numbers shown in FIGS. 2–5 are common to various manufacturers from which the parts are available, and with the detailed hardware connections illustrated in FIGS. 2–5, the construction of the present invention will be easily apparent.

Figure 2A:
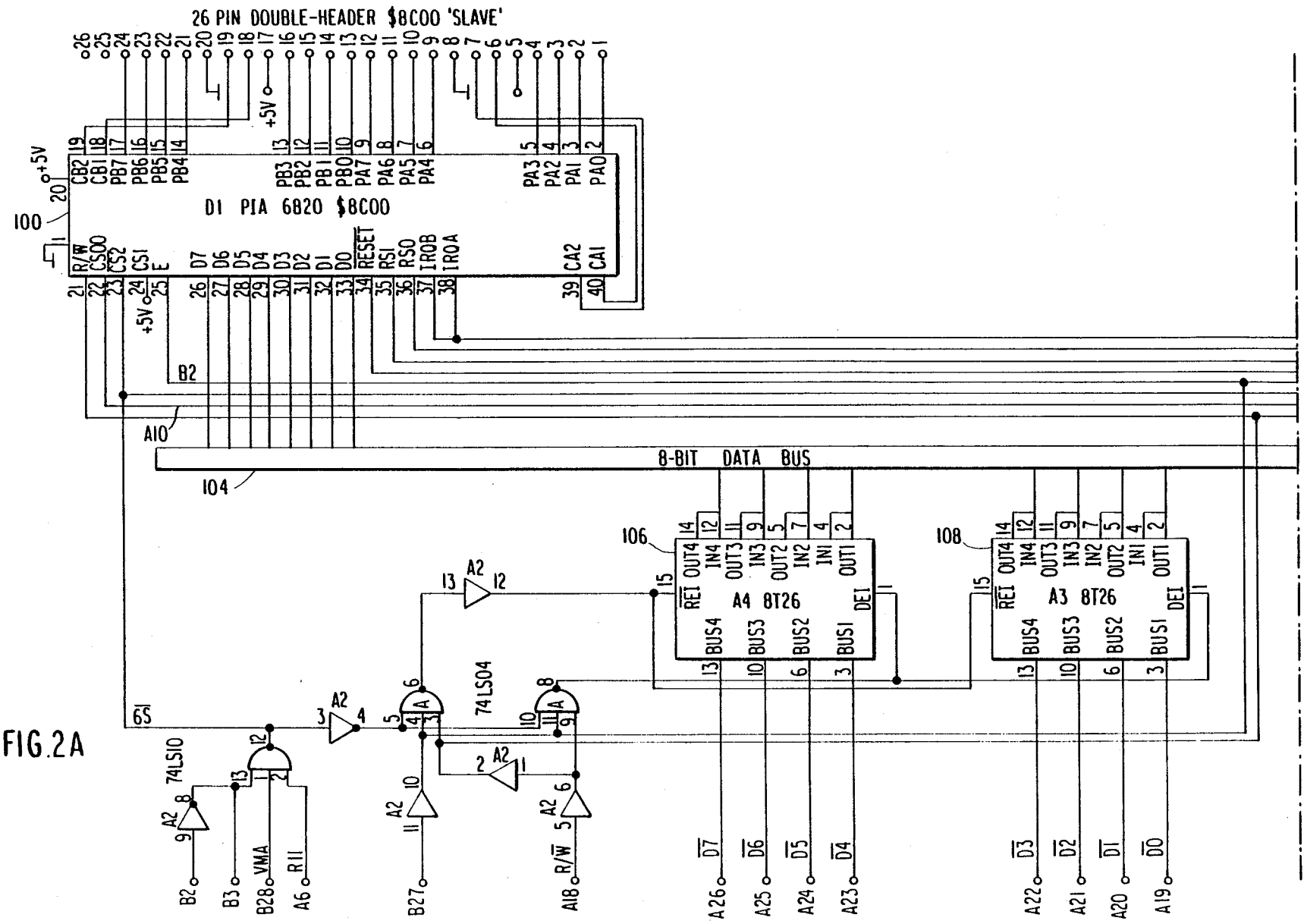
FIGS. 2A and 2B are a more detailed schematic diagram of the internal interface module (IIM) of FIG. 1.
Figures 2, 2A, 2B:
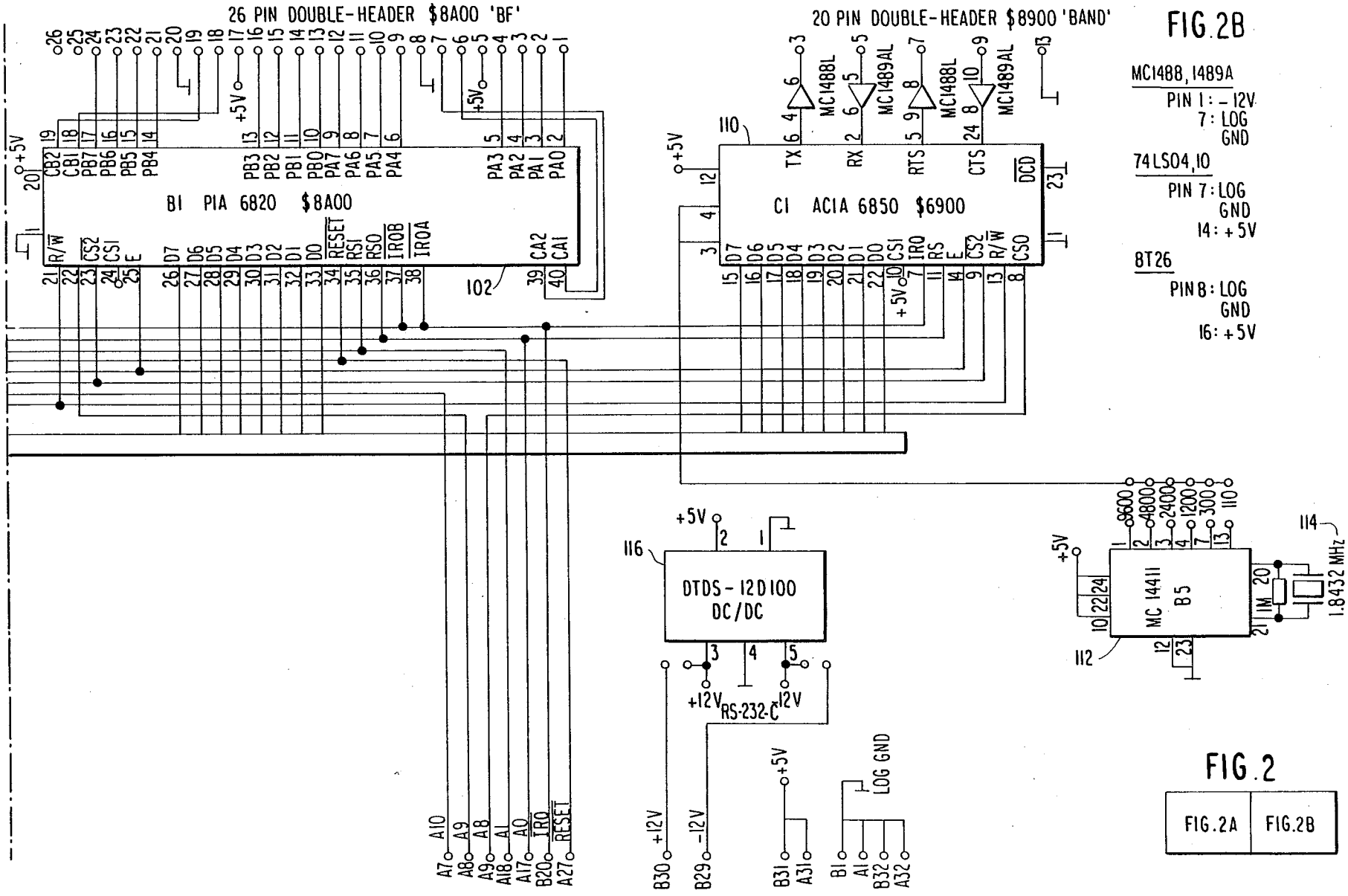

More particularly, referring to FIG. 2, the twin 6820 Peripheral Interface Adaptor (PIA) units 100, 102 each have their data outputs coupled to 8-bit data bus 104 for bidirectional data communications over the common bus 8 via numeral 8T26 transceivers 106, 108. A 6850 Asynchronous Communications Interface Adaptor (ACIA) 110 is provided for serial data communications, e.g. with the data carrier 6 in FIG. 1. Clock signals are provided from a bit rate generator 112 which frequency divides the output of a crystal oscillator 114 in a known manner. Power is supplied from DC/DC converter 116, available from Burr-Brown.

Figure 3A:
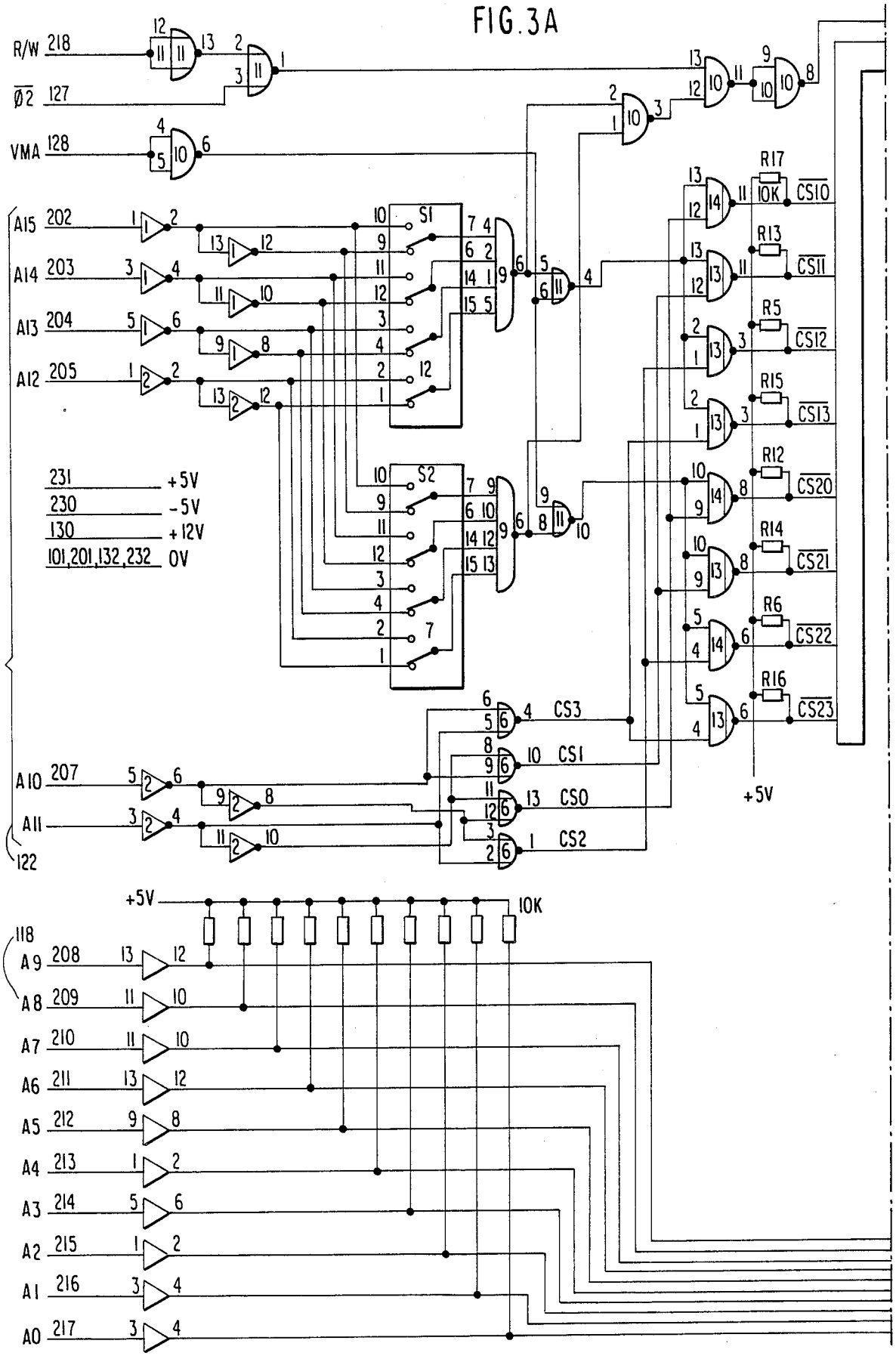
FIGS. 3A and 3B are a more detailed schematic diagram of the programmable read only memory (PROM) of FIG. 1.
Figures 3, 3B:
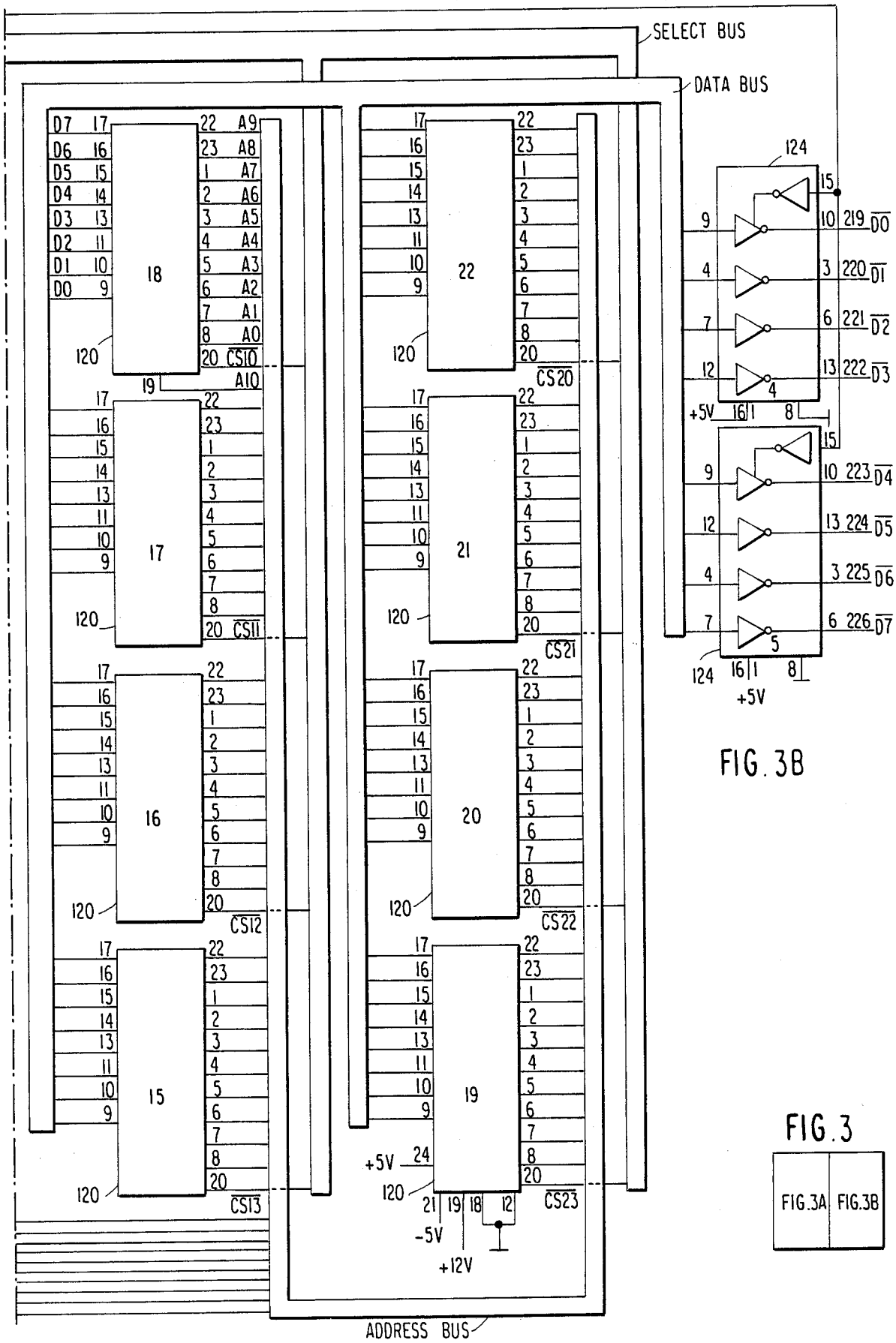

In FIG. 3, the PROM module receives its address via a first set 118 of address lines specifying the location in any given memory module 120 to be addressed, and a second set of address lines 122 specifying which one of the 8 modules 120 is to be addressed. The data output is provided via output buffers 124 to the data bus portion of the common bus 8 in FIG. 1.

Figure 4A:
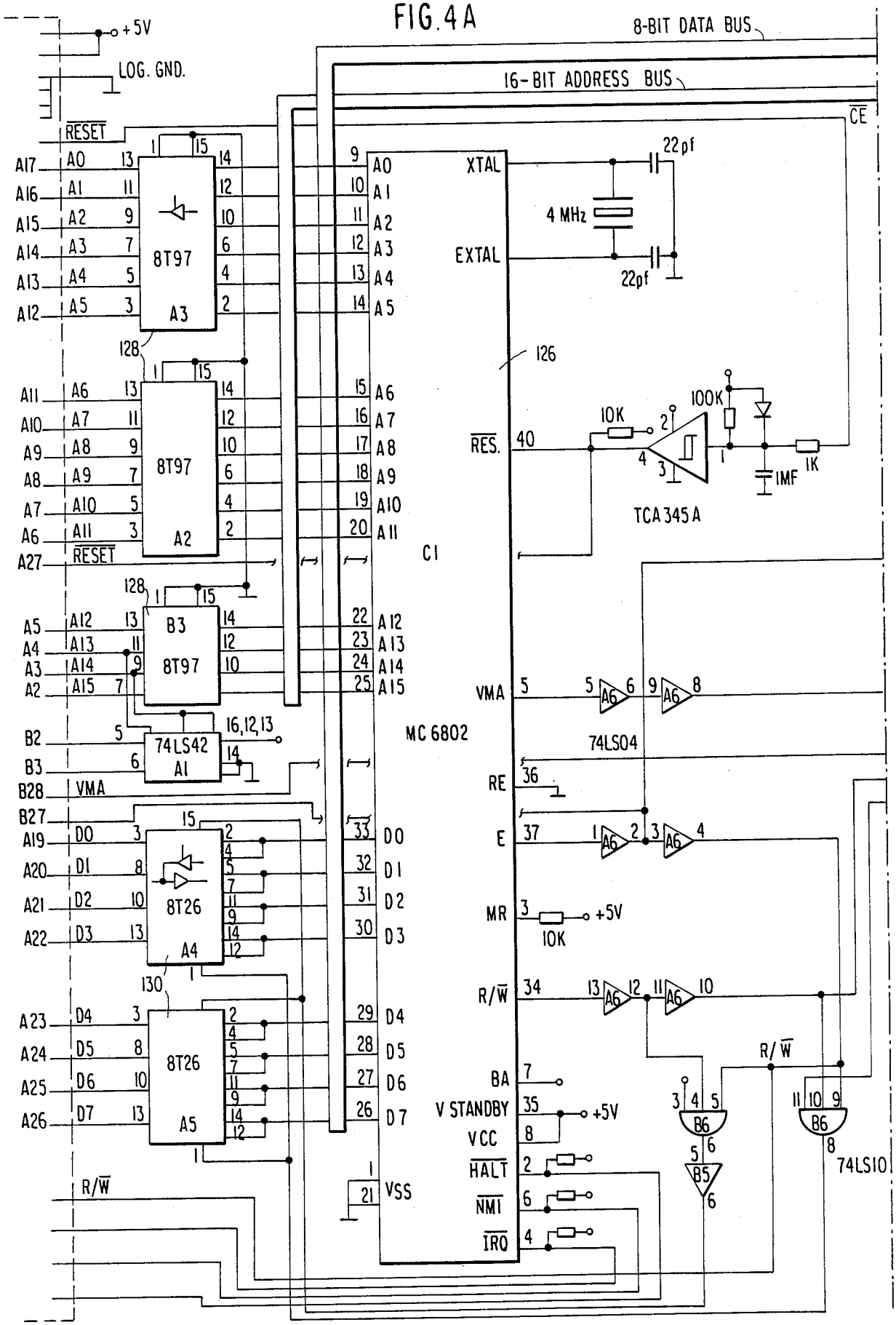
FIGS. 4A and 4B are a more detailed schematic diagram of the microprocessor module (MPM) of FIG. 1.
Figures 4, 4A, 4B:
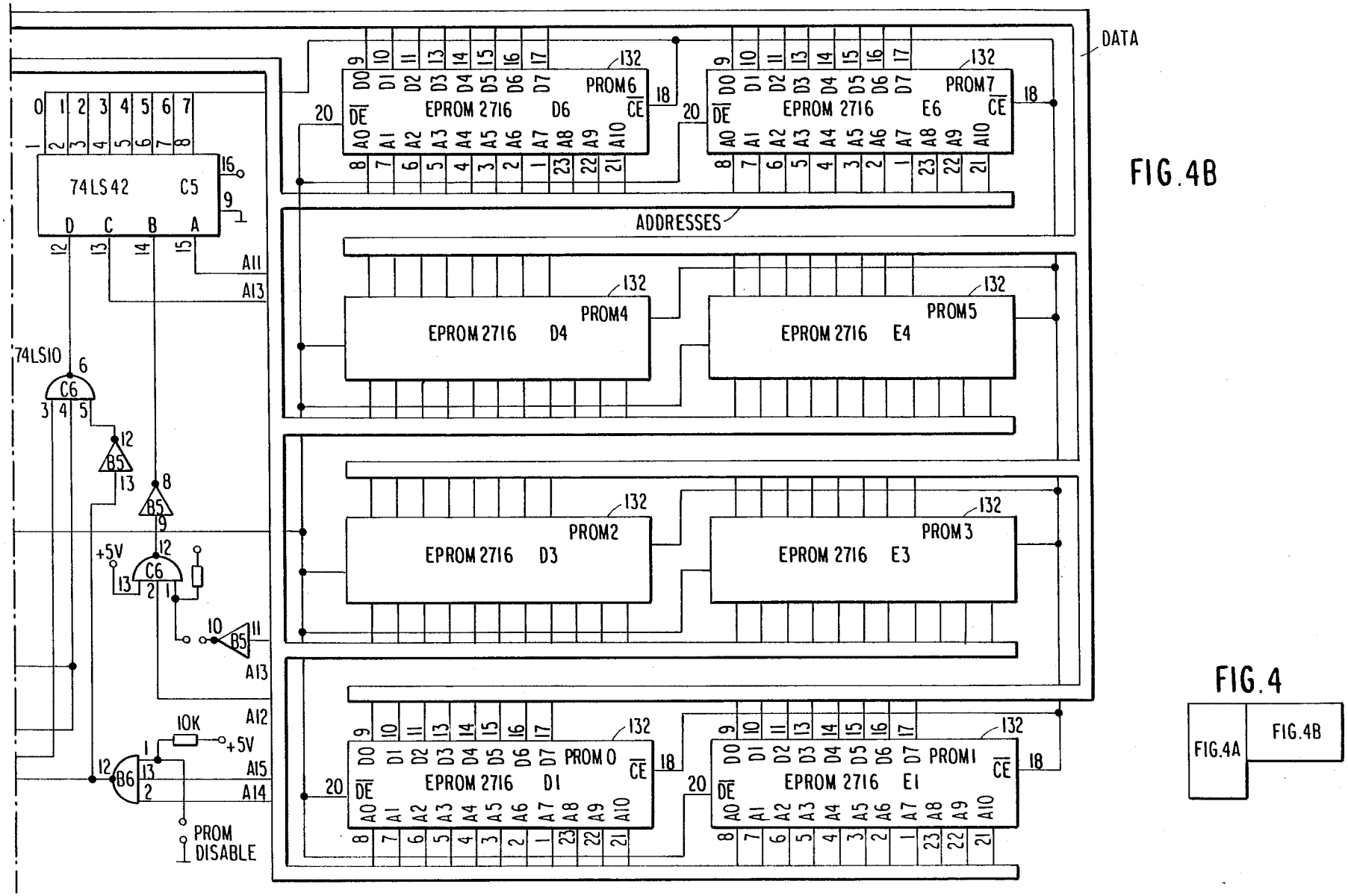

In FIG. 4, a 6802 microprocessor chip 126 communicates its 16-bit address information to the address portion of the common bus 8 via buffers 128, and is arranged for bidirectional data communication via output buffers 130. The microprocessor module is provided with 2716 Erasable Programmable Read Only Memory (EPROM) elements 132 for storage.

Figure 5A:
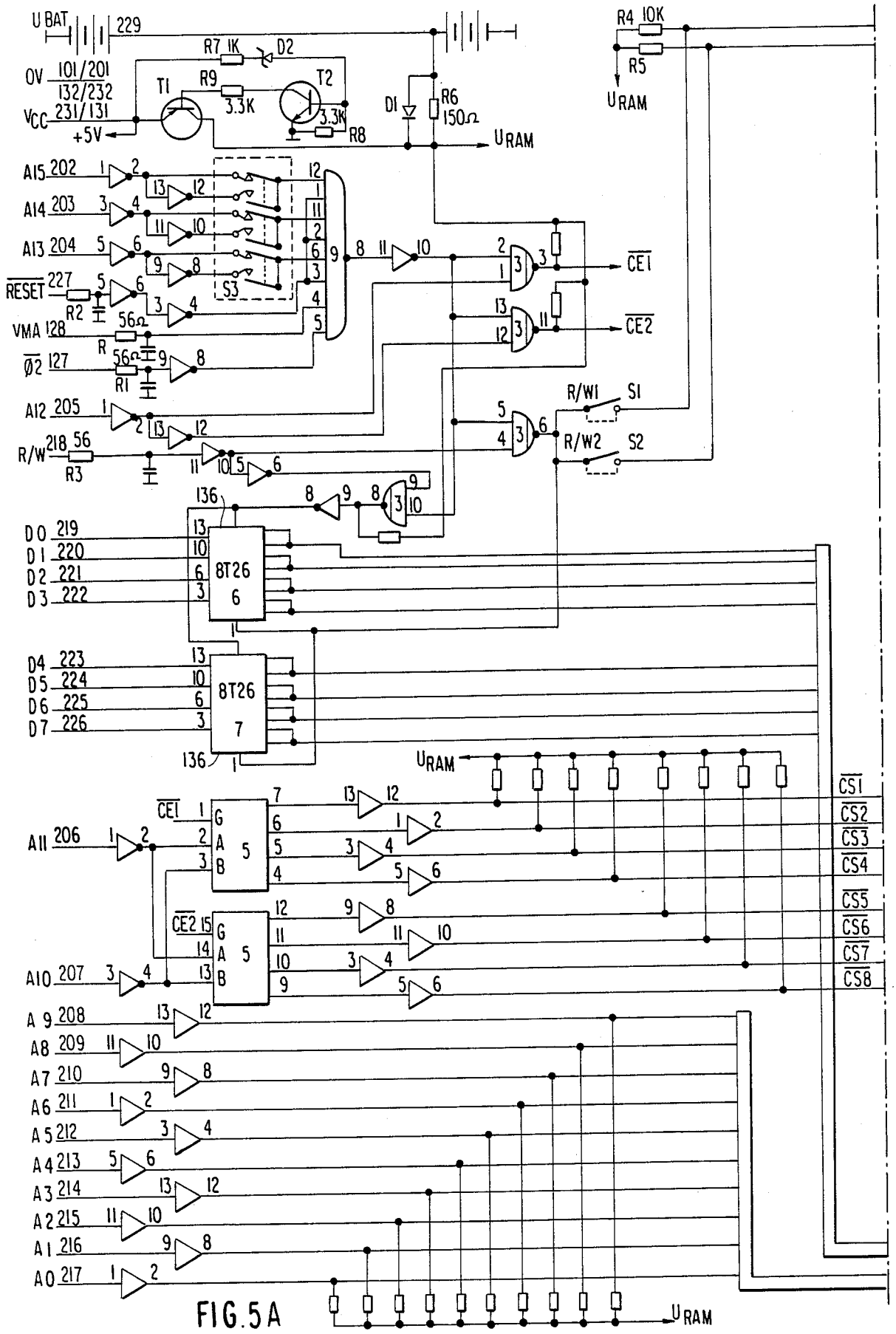
FIGS. 5A–5C are a more detailed schematic diagram of the random access memory (RAM) module of FIG. 1.
Figure 5B:
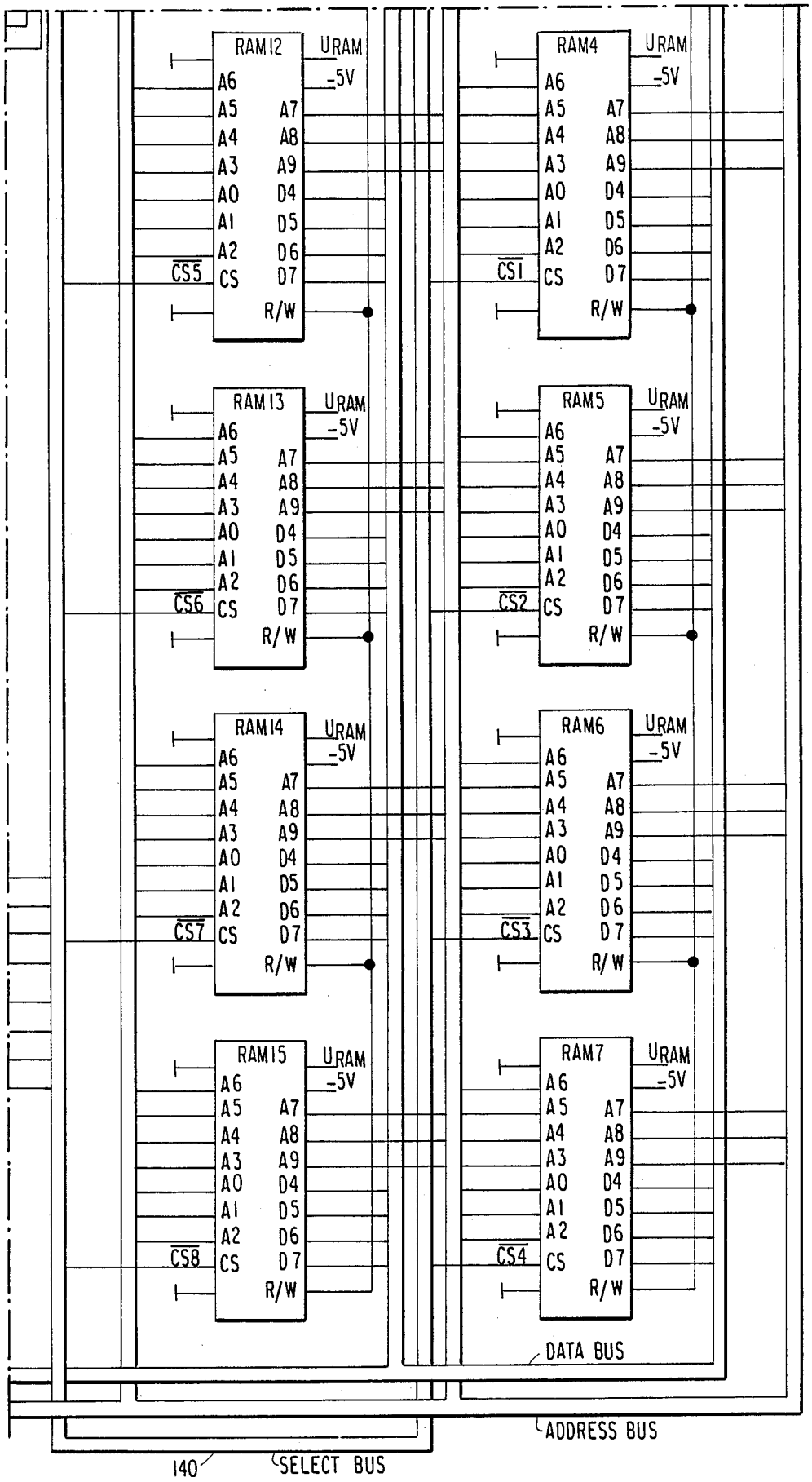
Figures 5, 5C:
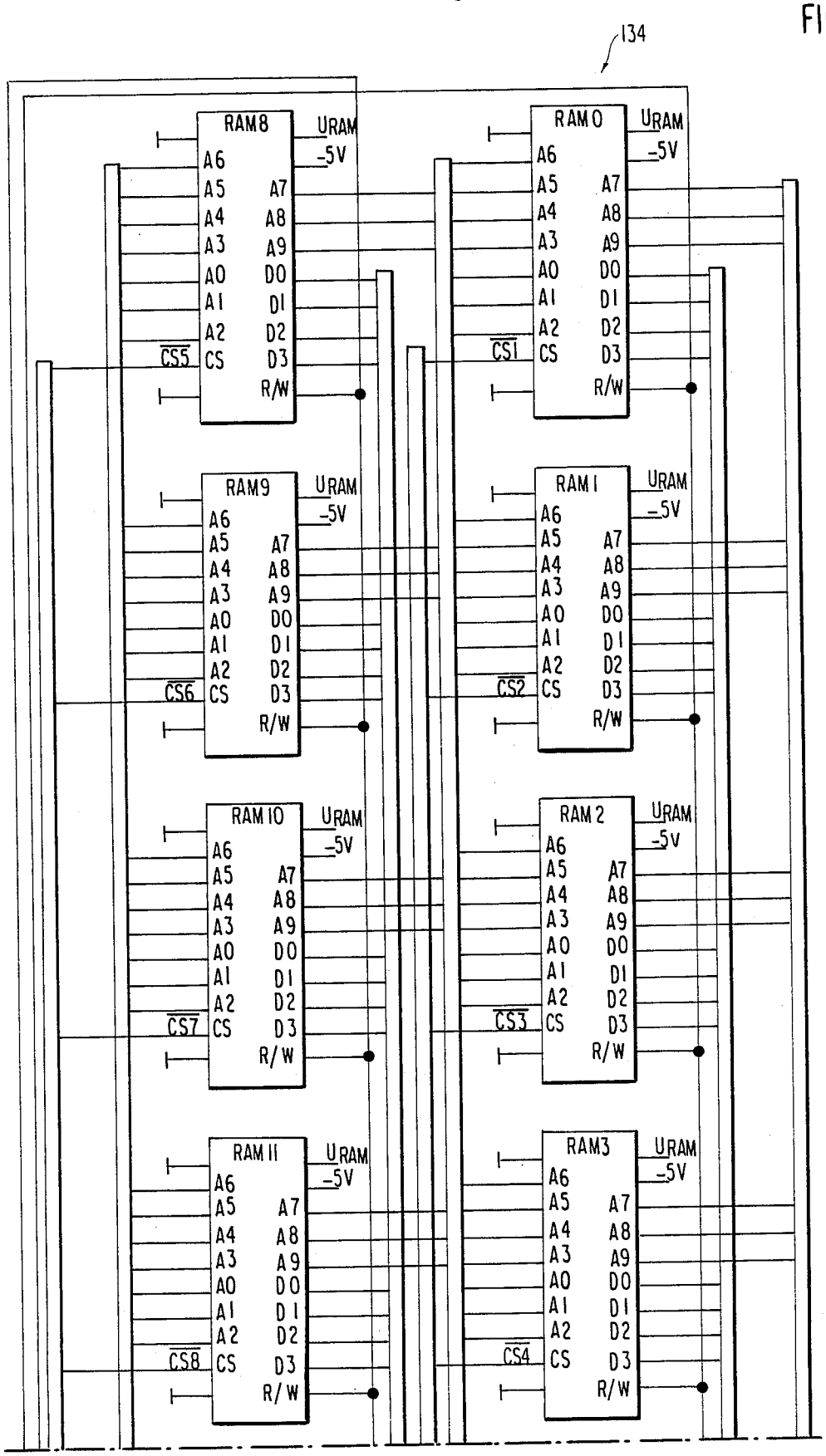

In FIG. 5, the Random Access Memory (RAM) module includes 16 ram chips 134 receiving 10 bits of address via lines A0–A9 from the common bus 8 in FIG. 1. Bidirectional data communication with the common bus 8 is accomplished via buffers 136. The remaining signals from the bus 8 are used to control the memory, for example, to control the reading and writing operations or to select via bus 140 which of the particular ram chips 134 is to be accessed.

For the operating function and construction respectively of the electronic control system according to claims 1 to 3, 5, 7 and 10 to 12 the blocks 1 to 5 are provided and used. For the operating function and construction respectively of the electronic control system according to claims 4, 6, 8 and 9 a data carrier device 6, e.g. a magnetic tape device, together with an associated data carrier, e.g. a magnetic tape cassette, is additonally connected to block 2.

We claim:

1. In an electronic control system for a flatbed knitting machine with electronic control, said control system being of the type having memory means for storing a first division of data containing motif pattern draft data, a second division of data containing needle set-up data, a third division of data containing knitting plan data, a fourth division of data containing function number schedule data and a fifth division of data containing plan run data, and data entry means for entering data into said memory means, said knitting machine being of the type wherein a pattern is knitted in accordance with selected data retrieved from said memory means according to a knitting program, said knitted pattern including at least one of a plurality of standard patterns each defined by a portion of the data in said third division and a portion of the data in said fourth division, the improvement comprising:

said memory means comprising a freely accessible memory, e.g. a random access memory (RAM), for storing said first, second and fifth data divisions; and a programmable fixed-word memory, e.g. programmable read only memory (PROM) for storing at least said third division of data and the portion of said fourth division of data necessary to define said standard patterns.

2. The improvement according to claim 1, in which the standard patterns are multi-coloured and inverted Jacquard patterns such as two-colour Jacquard patterns, three-colour Jacquard patterns, four-colour Jacquard patterns, half-tubular inverted patterns and cable patterns.

3. The improvement according to claim 1, wherein said data entry means includes means for entering directly into said fixed-word memory the data from the third division and the necessary part of the fourth division corresponding to said standard patterns.

4. The improvement according to claim 1, wherein said data entry means comprises a prepared external data carrier for entering directly into said fixed-word memory the data from the third division and the necessary part of the fourth division corresponding to said standard patterns.

5. The improvement according to claim 1, wherein said data entry means comprises means for entering directly into said memory means, split according to divisions, the data of the divisions not relevant to the standard patterns.

6. The improvement according to claim 1, wherein said data entry means comprises a prepared external data carrier for entering directly into said memory means, split according to divisions, the data of the divisions not relevant to the standard patterns.

7. The improvement according to claim 1, wherein said electronic control system further comprises a single function key for calling up the data for a standard pattern.

8. The improvement according to claim 1, wherein said electronic control system further comprises transfer means for transferring all data for the operation of the flatbed knitting machine, for each division individually or in combination, to external data carrier means, such as a magnetic tape cassette, from said memory means.

9. The improvement according to claim 8, wherein said means for transferring can transfer parts of the data of the divisions, from a minimum of the data for one needle, to the external data carrier means.

10. The improvement according to claim 1, wherein said electronic control system further comprises presettable counters for commanding a selection of one or more needle groups for knitting without altering the data already entered and stored.

11. The improvement according to claim 1, wherein said electronic control system further comprises switch means for suppressing one or more courses of knitting without altering the data already entered and stored.

12. The improvement according to claim 1, wherein said electronic control system includes a keyboard or switch means on the machine by means of which information related to the gauge of the flatbed knitting machine can be entered directly into the electronic control system.

* * * * *